US005328523A

United States Patent [19]

Fontaine et al.

[11] Patent Number: 5,328,523

[45] Date of Patent: Jul. 12, 1994

[54] COMPOSITE MULTILAYER MAGNETIC MATERIAL AND ITS PRODUCTION PROCESS

[75] Inventors: Jean-Marie Fontaine, Limours; Arnaud Varoquauz, Bines Sur Yvette, both of France

[73] Assignee: Commissariat A L'Energie Atomique, France

[21] Appl. No.: 853,735

[22] PCT Filed: Nov. 27, 1990

[86] PCT No.: PCT/FR90/00855

§ 371 Date: May 28, 1992

§ 102(e) Date: May 28, 1992

[87] PCT Pub. No.: WO91/08577

PCT Pub. Date: Jun. 13, 1991

[30] Foreign Application Priority Data

Nov. 28, 1989 [FR] France ..... 89 15616

[51] Int. Cl.[5] ..... C21D 1/04

[52] U.S. Cl. ..... 148/108; 427/130; 427/128; 427/132

[58] Field of Search ..... 148/108; 427/128, 130, 427/131, 132

[56] References Cited

FOREIGN PATENT DOCUMENTS 0308334 3/1989 European Pat. Off. .

OTHER PUBLICATIONS

IEEE Transactions on Magnetics vol. MAG-22, No. 2, Mar., 1986, IEEE, (New York, US), Y. Shimada: "Initial Permeability of Amorphous Single and Multilayered Films", pp. 89-92.

IEEE Translation Journal on Magnetics in Japan, vol. 3, No. 2, Feb. 1988, IEEE, (New York, US), M. Takahashi et al.: "Effect of Local Anistropy Fluctuation on the Permeability of Multilayered Co-Zr-Mo-Ni Amorphous Films", pp. 166-172.

Journal of the Electrochemical Society, vol. 136, No. 6, Jun. 1989, The Electrochemical Society Inc., (Manchester, N.H., US), O. J. Wimmers et al.: "Taper Etching of an Amorphous Soft Magnetic CoNbZr Alloy Using an Interfacial Organosilane Layer", pp. 1769-1772.

*Primary Examiner*—John P. Sheehan

*Attorney, Agent, or Firm*—Pearne, Gordon, McCoy & Granger

[57] ABSTRACT

The invention relates to a composite, multilayer magnetic material incorporating at least one thin polymer support film, which is mechanically and thermally strong, coated on at least one of its faces with a thin deposit of an amorphous ferromagnetic compound having a magnetic permeability higher than 30, in which the density d and the permeability of the magnetic material are such that $5 \leqq \mu/d \leqq 100$.

15 Claims, 2 Drawing Sheets

COMPOSITE MULTILAYER MAGNETIC MATERIAL AND ITS PRODUCTION PROCESS

DESCRIPTION

The present invention relates to a composite magnetic material in multilayer sheet form having a high magnetic permeability at high frequency and a low density, as well as to its production process.

This material can be used in magnetic heads for high frequency magnetic recording as a result of its high magnetic stability, as a core for a coil and very high frequency transformer, as an electromagnetic filter or shield used in telecommunications and data processing (shielding of complex circuits, computers, etc.), as a microwave absorber in an anechoic or echo-free chamber for experimental studies, or as an absorbent material in microwave ovens. In the latter application, the material according to the invention is placed on the inner face of the oven door.

Composite materials make it possible to obtain materials with a magnetic permeability and electrical permittivity adapted to each particular application. More specifically, the magnetic material according to the invention is used for equipped anechoic chambers.

The known materials used at present for this purpose are constituted by pyramidal patterns or honeycomb structures having a thickness of a few dozen centimetres and a low surface density between 1 and 5 $kg/m^2$. Unfortunately, this type of material is limited to a low wavelength range.

In addition, microwave-absorbing material are known in the form of thin films with a thickness of a few centimetres and made from dense materials such as ferrite, or from the dispersion of said dense materials in an appropriate organic binder. This type of material suffers from the disadvantage of being heavy ($>10$ $kg/m^2$). These materials have a low magnetic permeability leading to considerable thicknesses and corresponding high weights.

To obviate these disadvantages, the invertor has envisaged producing a composite magnetic material constituted by an alternation of amorphous ferromagnetic layers and electrically insulating layers, each ferromagnetic material layer being formed from several blocks separated from one another by electrically insulating joints. This principle is described in FR-A-2 620 853. Unfortunately the magnetic material described in the latter document cannot at present be produced and its production process is very difficult to carry out.

In particular, the above document teaches the production of 10 micrometer etching lines for a stack of layers having a thickness of 70 to 600 micrometers. However, at present, even when using a laser etching process, the etching line width is at a minimum one or two times the thickness of the stack (or layers) to be etched.

The present invention relates to a composite, multilayer magnetic material making it possible to obviate the disadvantages referred to hereinbefore. In particular, said material has a low density and a high magnetic permeability. Its production process can also be carried out industrially and performed relatively easily.

The material according to the invention simultaneously combines excellent performance characteristics and high production speeds.

More specifically, the invention relates to a composite, multilayer magnetic material having at least one thin, polymer support film, which is mechanically and thermally strong, which is coated on at least one of its faces by a thin deposit of a ferromagnetic amorphous compound, the density d and the permeability $\mu$ of the composite magnetic material being such that $5 \leqq \mu/d \leqq 100$.

According to the invention a ferromagnetic deposit can be provided on each face of the support film. Moreover, according to the envisaged application several support films in each case coated by the ferromagnetic deposit or deposits and joined by an adhesive film can be used. In this stack, the ferromagnetic deposits can be made from the same material or from different materials so as to modify the magnetic permeability spectrum.

Contrary to the case of FR-A-2 620 853, said multilayer material is not subject to delamination.

According to the invention, the volume percentage of metal compared with the total volume of the composite material is below 50%, which corresponds to a Vm/Vi ratio $<10$ and is generally between 10 and 20%, which corresponds to a ratio $2 \leqq Vm/VI \leqq 4$.

This metal volume percentage is below that of the material according to FR-A-2 620 853 containing 50 to 90% by volume metal.

The permeability of the composite material is dependent on that of the ferromagnetic material used and its concentration. Values of a few hundred to one hundred MHz can be reached with a composite material with a density of 3.5.

The use of a ferromagnetic material with a high magnetic permeability ensures a good stability of the materials up to frequencies of a few hundred MHz and even up to 1 GHz.

In general terms, the ferromagnetic material usable according to the invention are those having a magnetic permeability above 300, $4\pi Ms \geqq 0.5$ T, with Ms representing the saturation magnetization of the ferromagnetic material, as well as a magnetic anisotropy field Ha from 0 to 2500 A/m.

The ferromagnetic materials more particularly usable according to the invention are amorphous compounds with a high cobalt content, i.e. containing at least 75% of cobalt atoms. Ferromagnetic materials usable within the scope of the present invention are $Co_{87}Nb_{11.5}Zr_{1.5}$, $Co_{89}Nb_{6.5}Zr_{4.5}$, $Co_{89}Zr_{11}$, $Co_{93}Zr_{7}$, or $Co_{79}Zr_{10}Mo_{9}Ni_{2}$.

The thickness of the ferromagnetic deposits is a function of the envisaged application. Particularly with regards to microwave-absorbing materials (i.e. anechoic chambers or microwave ovens), the higher the frequencies to be absorbed, the thinner each ferromagnetic deposit.

Generally, the thickness of each ferromagnetic deposit is less than the penetration depth of the use frequencies. For example for 100 MHz, use is made of ferromagnetic deposits smaller than 2 micrometers. However, for frequencies of 10 MHz, a few micrometers (approximately 5 to 6) can be used for the ferromagnetic deposit. Generally the ferromagnetic layers have a thickness between 10 nm and 10 micrometers.

According to the invention, the support film must be thermally stable and in particular at between 150° and 300° C. In particular, said film must not be a thermoplastic. Moreover, the film must be thin, i.e. below 10 micrometers. Films between 0.8 and 1.5 micrometer can be used.

In addition, the support film must be mechanically strong or resistant, particularly to tearing. Support films with a tearing strength of 18 to 50 mg/mm$^2$ can be used.

As a polymeric film usable within the scope of the invention, reference is made to polyimides such as Kapton, polycarbonates, polyesters, ethylene glycol polyterephthalates such as Mylar or polyether ether ketone such as Peek.

Excellent results are obtained with Mylar films with an approximate thickness of 1.5 micrometer.

If the high conductivity of the ferromagnetic deposits is prejudicial to the envisaged application, the latter can be cancelled out in the composite material by etching strips of blocks in each ferromagnetic deposit.

The ferromagnetic deposit or deposits can also in each case be coated with a thin electrically insulating layer. Electrically insulating materials usable in the invention are quartz, glass, silica, amorphous silicon, aluminium, silicon nitride and zinc sulphide. The electrically insulating layers can have a thickness between 10 and 100 nm.

The invention also relates to a process for the production of the composite magnetic material as described hereinbefore. This process consists of passing the support film into a deposition enclosure, in which there is a residual vacuum of $<10^{-5}$ Pa, followed by the continuous deposition on at least one of the faces of the moving film of a layer of a ferromagnetic compound.

The vacuum deposition of ferromagnetic layers on a moving film is relatively simple to carry out and is compatible with a high production rate.

Moreover, when the magnetic material has a ferromagnetic deposit with etching lines, the latter are made continuously with the aid of a laser beam on the moving ferromagnetic deposit.

This etching procedure is not expensive and is compatible with a high production speed. It also ensures high dynamics of the etching width regulatable to between 5 and 500 micrometers, as a function of the thickness of the layers to be etched.

Etching by laser, whilst moving, requires the use of a laser, whose wavelength is not absorbed by the support film. In other words, the support film must be perfectly transparent to the wavelength of the chosen laser. For example, an infrared laser is very suitable for a Mylar support film.

Thus, etching can be obtained by sublimation of the ferromagnetic layer without deterioration to the support film.

However, it is also possible to chemically etch the ferromagnetic deposit using a photolithographic mask.

According to the invention, it is also possible to directly form, during the deposition of the ferromagnetic material, the ferromagnetic strips or blocks by selective depositions using a mask. For example, the known lift-off procedure can be used. It consists of forming a photolithographic resin mask on the support film, the resin masking the film regions from which the ferromagnetic material is to be removed, followed by the vacuum deposition on the complete structure of a ferromagnetic layer and then the elimination of the resin mask, the ferromagnetic material surmounting the resin being eliminated at the same time as the latter.

In order to fix the magnetic orientation of the ferromagnetic deposits, whilst improving the reproducibility of the composite material, there is an application of a weak magnetic field (a few hundred A/m) parallel to the support film plane.

Finally, to improve the magnetic permeability of the composite material, annealing under a rotary or fixed magnetic field can be used. The annealing temperatures are between 100° and 300° C. and the magnetic field amplitude varies between 10 and 100 kA/m. For a rotary field, the rotation speed is between $2\pi$ and $20\pi$ rad/m.

The invention is described in greater detail hereinafter relative to non-limitative embodiments and the attached drawings, wherein show:

Figure 1:
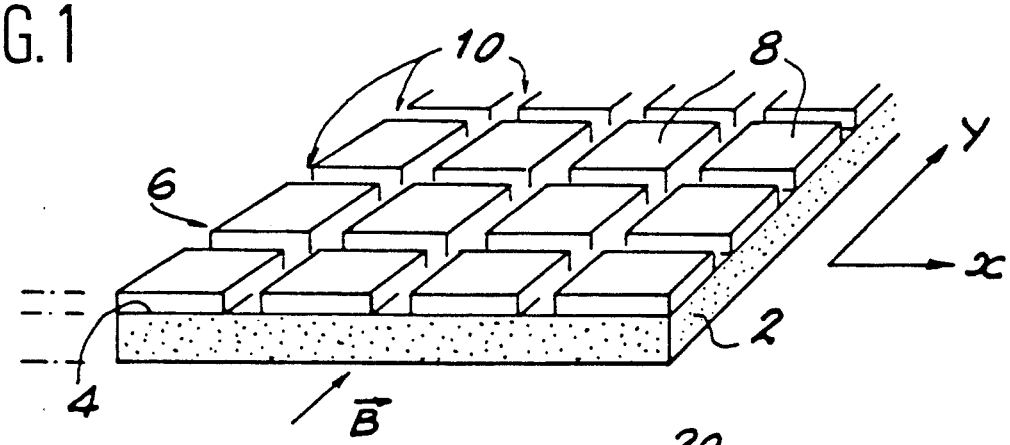
FIGS. 1 to 4 Diagrammatically different embodiments of the composite material according to the invention.

The composite material shown in FIG. 1 is a monolayer material. It has a polymeric film 2, which is thermally resistant between 150° and 300° C. and which has a tearing strength between 18 and 50 kg/mm$^2$. The thickness of this polymeric film 2 is 1 to 4 micrometers and is provided on its upper face 4 with a ferromagnetic material layer 6 with a magnetic permeability above 300 and in particular above 600, together with a thickness of 300 to 800 nm. This layer 6 is constituted by square blocks 8 with a surface of 2 to 10 mm$^2$, separated by etching lines 10 with a width of 400 to 2000 nm, as a function of the ferromagnetic layer thickness.

According to the invention, the density d of the composite material and its magnetic permeability $\mu$ are linked by the equation $5 \leqq \mu/d \leqq 100$ and in particular by the equation $10 \leqq \mu/d \leqq 100$.

According to the invention, continuous deposition takes place by vacuum sputtering or evaporation of the ferromagnetic layer 6 on the moving support film 2. Deposition of the ferromagnetic layer 6 takes place under a residual vacuum of $<10^{-5}$ Pa. The film movement speed is linked with the deposition technology used.

In the case of sputtering, the speed is 10 to 20 cm/minute, whereas in the case of evaporation the speed can be one meter per second.

The ferromagnetic material deposit 6 is formed by simultaneously applying a magnetic field of a few hundred A/m (approximately 10 kA/m) parallel to the plane of the film 2. Using a laser beam first ferromagnetic strips are cut in the layer 6 parallel to the direction x. This is followed by a second cutting of the ferromagnetic deposit 6 in a direction y perpendicular to the direction x. The laser is an infrared laser with a wavelength of 1060 nm for a Mylar support film 2.

After producing etching lines 10, annealing takes place at between 150° and 300° C., in the presence of a rotary or fixed magnetic field $\bar{B}$ of a few hundred A/m (80 kA/m) contained in the plane of the support film 2.

Figure 2:
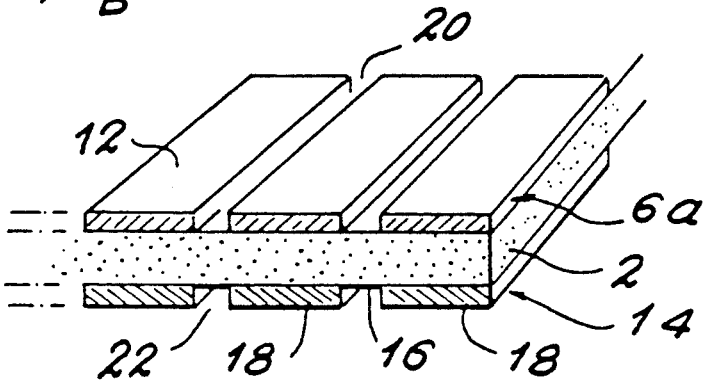

According to the invention, the ferromagnetic deposit 6*a* can also be constituted by ferromagnetic strips 12, as shown in FIG. 2.

In the manner described hereinbefore, it is also possible to deposit a second ferromagnetic layer 14 on the face 16 opposite to the face 4 of the support film. This layer 14 can be constituted by parallel strips 18 or blocks. The etching lines 20, 22 (FIG. 2) of the upper 6*a* and lower 14 ferromagnetic deposits can be displaced.

According to the envisaged application, it is possible to stack and assemble several structures or sheets or layers, as shown in FIGS. 1 or 2.

Figure 3:
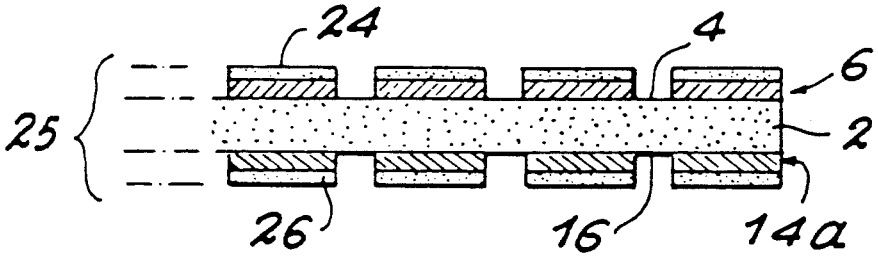

As shown in FIG. 3, it is also possible to deposit electrically insulating materials 24 and 26 respectively on the ferromagnetic deposits 6 and 14*a* covering the two faces 4 and 16 of the support 2. In this drawing, the deposits 6 and 14*a* are in the form of square blocks. This also applies with regards to the insulating materials 24 and 26. The complete structure carries the reference 25. These insulating layers have a thickness of 10 to 100 nm. Their etching lines are produced at the same time as those of the ferromagnetic deposits using a laser beam and consequently coincide.

Figure 4:
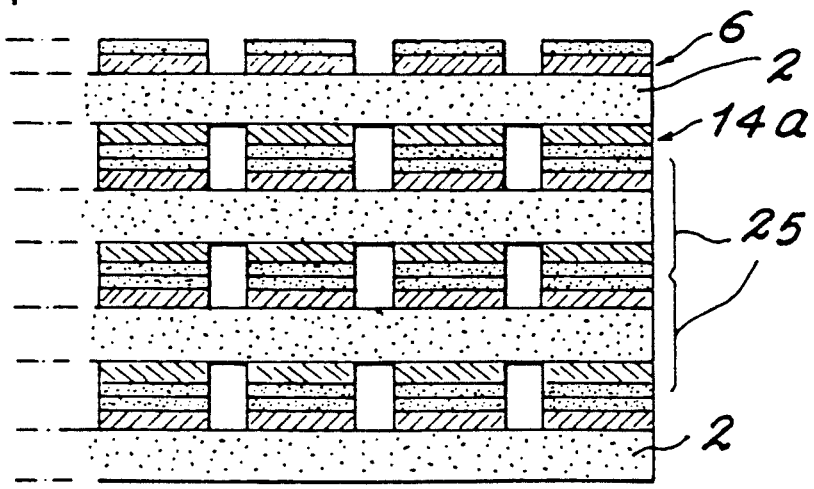

FIG. 4 shows a stack of several structures or layers 25. The number of layers or sheets 25 can be between 1 and 500. The assembly of these layers is brought about with the aid of an adhesive joint. The adhesive used is a heat-resistant fluid polyester.

The stack of the different layers can be produced by winding, draping or any other known procedure.

Moreover, the adhesive film is obtained by spraying, which makes it possible to deposit submicron adhesive thicknesses of typically 0.2 micrometer.

The following examples of composite materials according to the invention are given for illustration.

EXAMPLE 1

A 400 nm thick deposit of $Co_{79}Zr_{10}Mo_9Ni_2$ is produced by cathodic sputtering on the two faces of a 3.5 micrometer Mylar film moving at 20 cm/min. This deposit is made in a planar magnetic field of 800 A/m, in a BVT cathodic sputtering frame, in which there is a residual vacuum below $10^{-5}$ Pa.

This is followed by a 50 nm thick $SiO_2$ deposit on each ferromagnetic deposit by PECVD (plasma assisted chemical vapour deposition).

After annealing at 230° C., in the presence of a planar magnetic field of 70 kA/m of the structure obtained, using a 1060 nm YAG laser 100 micrometer wide etching lines are formed for the $SiO_2$ layers and are constituted by blocks having a side length of 3 mm. This etching takes place with the sheet moving at 0.15 m/s.

300 sheets obtained in the aforementioned manner are assembled, adhesion being ensured by a 0.2 micrometer polyester adhesive film. The composite material obtained has a magnetic permeability of 90 and a density of 2, i.e. a $\mu/d$ ratio of 45.

EXAMPLE 2

Example 2 differs from example 1 by the use of 50 adhered sheets or layers, each constituted by a single 400 nm $Co_{87}Nb_{11.5}Zr_{1.5}$ deposit on the Mylar film, covered by a thin 20 nm $SiO_2$ film. The etching lines are the same as in example 1. This composite material has a density of 2 and a $\mu/d$ ratio of 7 to 300 MHz.

Figure 5:
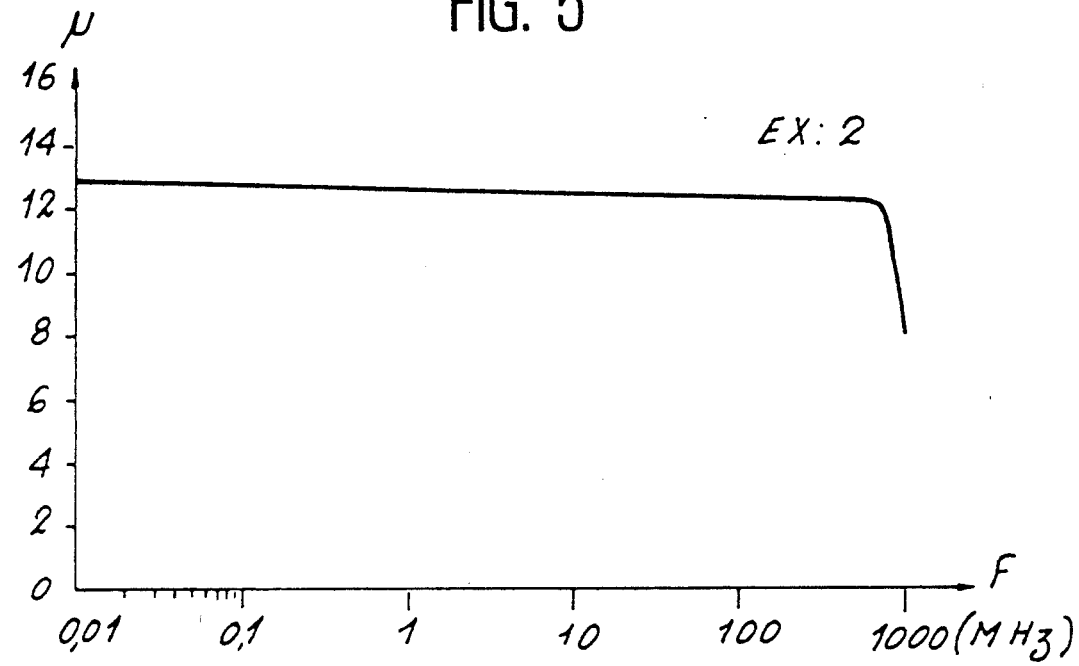
FIGS. 5 and 6 Curves giving the variations of the magnetic permeability of two composite materials according to the invention as a function of the frequency of the incident electromagnetic wave in MHz.

The magnetic permeability variations of the assembly as a function of the frequency of the instant wave are given in FIG. 5. The frequencies are given in a logarithmic scale.

EXAMPLE 3

In this example, the composite material is formed from 50 adhered layers, each constituted by a 400 nm $Co_{87}Nb_{11.5}Zr_{1.5}$ deposit on the two faces of a 3.5 micrometer thick Mylar film, said deposit being covered by a thin 20 nm $SiO_2$ film. The etching lines are the same as in example 1. This composite material has a density of 2.5 and a $\mu/d$ ratio of 10 to 300 MHz.

Figure 6:
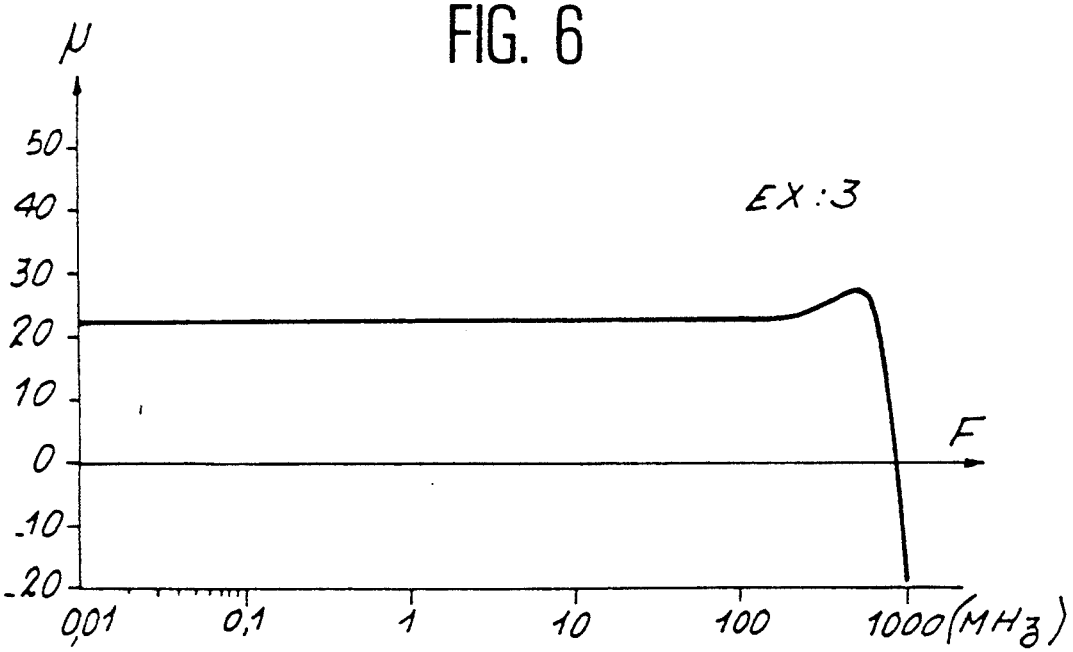

The permeability variations of the assembly as a function of the frequency of the instant wave are given in FIG. 6. The frequencies are illustrated in logarithmic form.

FIGS. 5 and 6 clearly show that the magnetic permeability of the composite materials according to the invention remain stable over considerable wavelength ranges.

The following table gives the $\mu/d$ ratio of the composite materials of examples 1, 2 and 3 for different incident electromagnetic wave frequencies, as well as that of a conventional ferrite material. The table makes it clear that the composite materials according to the invention have a higher $\mu/d$ ratio than that of ferrite and that said ratio remains constant, even at high frequencies.

TABLE

| | u/d value as a function of the frequency | | |
|---|---|---|---|
| | 100 MHz | 200 MHz | 600 MHz |
| Ferrite | 4 | 1 | 0.2 |
| Ex. 1 | 45 | 45 | 45 |
| Ex. 2 | 7 | 7 | 7 |
| Ex. 3 | 10 | 10 | 10 |

What is claimed is:

1. Process for the production of a composite magnetic material in the form of sheets (25) having at least 50 integral sheets, consisting of forming each sheet by passing a mechanically strong and thermally stable polymer support film (2) having a thickness below 10 μm into a deposition enclosure in which there is a vacuum with a residual pressure of $<10^{-5}$ Pa and by continuously depositing on at least one of the faces (4, 16) of the moving film a coating (6, 14) with a thickness of 300 nm to 10 μm of an amorphous ferromagnetic compound and assembling the sheets obtained to form a stack of sheets (25), the density d and magnetic permeability $\mu$ of the composite magnetic material being such that $5 \leqq \mu/d \leqq 100$.

2. Process according to claim 1, wherein the support film (2) is thermally stable between 150° and 300° C.

3. Process according to claim 2, wherein the support film (2) is a material selected from the group consisting of polyimides, polycarbonates, polyesters and ethylene glycol polyterephthalates.

4. Process according to claim 1, wherein the support film (2) has a tearing strength of at least 18 $kg/mm_2$.

5. Process according to claim 1, wherein the coating of the ferromagnetic compound has a thickness of 300 to 800 nm.

6. Process according to claim 1, wherein the ferromagnetic compound is a compound based on cobalt having a magnetic permeability exceeding 300.

7. Process according to claim 1, wherein the ferromagnetic compound is selected from the group consisting of $CO_{87}Nb_{11.5}Zr_{1.5}$ and $CO_{79}Zr_{10}Mo_9Ni_2$.

8. Process according to claim 1, wherein the coating of the ferromagnetic compound has etching lines (10, 20, 22) defining parallel strips (18) or blocks (8).

9. Process according to claim 8, wherein the coating of the ferromagnetic compound of each coating is covered with a thin electrically insulating film (24, 26).

10. Process according to claim 9, wherein the thin insulating film (24, 26) has a thickness of 10 to 100 nm.

11. Production process according to claim 1 of a magnetic material, whereof each coating of the ferromagnetic compound has etching lines (10, 20, 22), wherein the etching lines are made on each sheet continuously whilst moving of the film (2), using a laser beam.

12. Process according to claim 1, wherein a magnetic field is applied parallel to the plane of the support film during the deposition of the ferromagnetic compound of each sheet.

13. Process according to claim 12, wherein the laser has a wavelength essentially transmitted by the support film (2).

14. Process according to claim 13, wherein annealing of the composite material takes place under a magnetic field (B).

15. Process according to claim 14, wherein the sheets are joined together to form a stack by an adhesive film.

* * * * *